US005879476A

United States Patent [19]

Narushima et al.

[11] Patent Number: 5,879,476

[45] Date of Patent: Mar. 9, 1999

[54] COPPER ALLOY HAVING IMPROVED CORROSION RESISTANCE, COMMUTATOR AND MOTOR USING THE SAME

[75] Inventors: Masahiko Narushima, Gunma-ken; Kazuhiko Nakagawa; Gen Sasaki, both of Ibaraki-ken, all of Japan

[73] Assignees: Hitachi Cable, Ltd., Tokyo; Mitsuba Corporation, Gunma-ken, both of Japan

[21] Appl. No.: 731,358

[22] Filed: Oct. 11, 1996

[30] Foreign Application Priority Data

Oct. 12, 1995 [JP] Japan ..... 7-264490

[51] Int. Cl.[6] ..... C22C 9/00; C22C 9/02

[52] U.S. Cl. ..... 148/433; 148/435; 29/597; 310/233

[58] Field of Search ..... 148/433, 435; 420/473, 485; 29/597; 310/233

[56] References Cited

U.S. PATENT DOCUMENTS 5,552,106 9/1996 Kembaiyan ..... 419/5

FOREIGN PATENT DOCUMENTS

| | | |
|---|---|---|
| 49-122420 | 11/1974 | Japan . |
| 03-024241 | 2/1981 | Japan . |
| 62-067144 | 3/1987 | Japan . |
| 62-240732 | 10/1987 | Japan . |
| 3-31437 | 6/1989 | Japan . |
| 01-198440 | 8/1989 | Japan . |
| 03-006341 | 1/1991 | Japan . |
| 5-239573 | 4/1991 | Japan . |
| 4-224642 | 8/1992 | Japan . |

*Primary Examiner*—Sikyin Ip
*Attorney, Agent, or Firm*—McDermott, Will & Emery

[57] ABSTRACT

A copper alloy having an improved corrosion resistance in an alcohol-containing medium, which consists essentially of 0.5 to 8 weight percent tin and/or nickel alone or in combination, 0.02 to 0.15 weight percent zirconium, and remainder weight percent copper. The zirconium is dispersed in the copper alloy as precipitates. The copper alloy is suitable for a commutator material used in a DC motor having an improved abrasive resistance.

2 Claims, 1 Drawing Sheet

COPPER ALLOY HAVING IMPROVED CORROSION RESISTANCE, COMMUTATOR AND MOTOR USING THE SAME

BACKGROUND OF THE INVENTION

1. Technical Field

This invention relates to copper alloy, and more particularly, to a copper alloy which is suitable for a commutator of a DC motor used for an alcohol-containing fuel supply pump.

A fuel supply pump is broadly used for supplying fuel to an engine in many kinds of vehicles, such as automobiles. Such fuel supply pump comprises a pump portion for supplying fuel to the engine and a motor portion for driving the pump portion. The motor portion usually comprises a DC motor and a commutator by which the motor is driven by a DC power supply. Conventionally, silver containing copper alloys are used for such a commutator, because such copper alloys prevent the commutator from being softened by the heat of a molding resin which covers the commutator.

As a fuel for automobiles, gasoline or light oil has been used. Recently, however, in view of concerted efforts to prevent global environmental pollution, alcohol-containing fuels are proposed to be used for cleaning up automobile exhaust gases. When the conventional copper alloys are used for a commutator of a DC motor used in such an alcohol-containing fuel, however, there is a disadvantage in that the commutator, which is made of a silver-containing copper alloy, is corroded, because alcohol is more corrosive than the conventional gasoline or light oil, thereby resulting in deteriorating the durability of the motor.

2. Disclosure of the Invention

Accordingly, it is an object of the invention to provide a copper alloy which is not corroded in an alcohol-containing medium.

It is a further object of the invention to provide a commutator for a motor in which the abrasive resistance characteristics in an alcohol-containing medium are improved.

It is a still further object of the invention to provide a motor in which the durability in an alcohol-containing medium is improved.

According to the first feature of the invention, a copper alloy consists essentially of:

0.5 to 8 weight percent tin or nickel alone or in combination, 0.02 to 0.15 weight percent zirconium, and the remainder weight percent copper; the zirconium being dispersed in the copper alloy as precipitates.

According to the second feature of the invention, a commutator for a motor made of a copper alloy, the copper alloy consisting essentially of:

0.5 to 8 weight percent tin or nickel alone or in combination, 0.02 to 0.15 weight percent zirconium, and the remainder weight percent copper; the zirconium being dispersed in the copper alloy as precipitates.

According to the third feature of the invention, a motor for supplying a medium pump which comprises:

a pump portion for supplying the medium; and a motor portion for driving the pump portion; the motor portion comprising a DC motor and a commutator, the commutator made of a copper alloy which consists essentially of:

0.5 to 8 weight percent tin or nickel alone or in combination, 0.02 to 0.15 weight percent zirconium, and the remainder weight percent copper; the zirconium being dispersed in the copper alloy as precipitates.

BRIEF DESCRIPTION OF DRAWINGS

The invention will be explained in more detail in conjunction with the appended drawing, wherein.

BRIEF DESCRIPTION OF THE PREFERRED EMBODIMENTS

Figure 1:
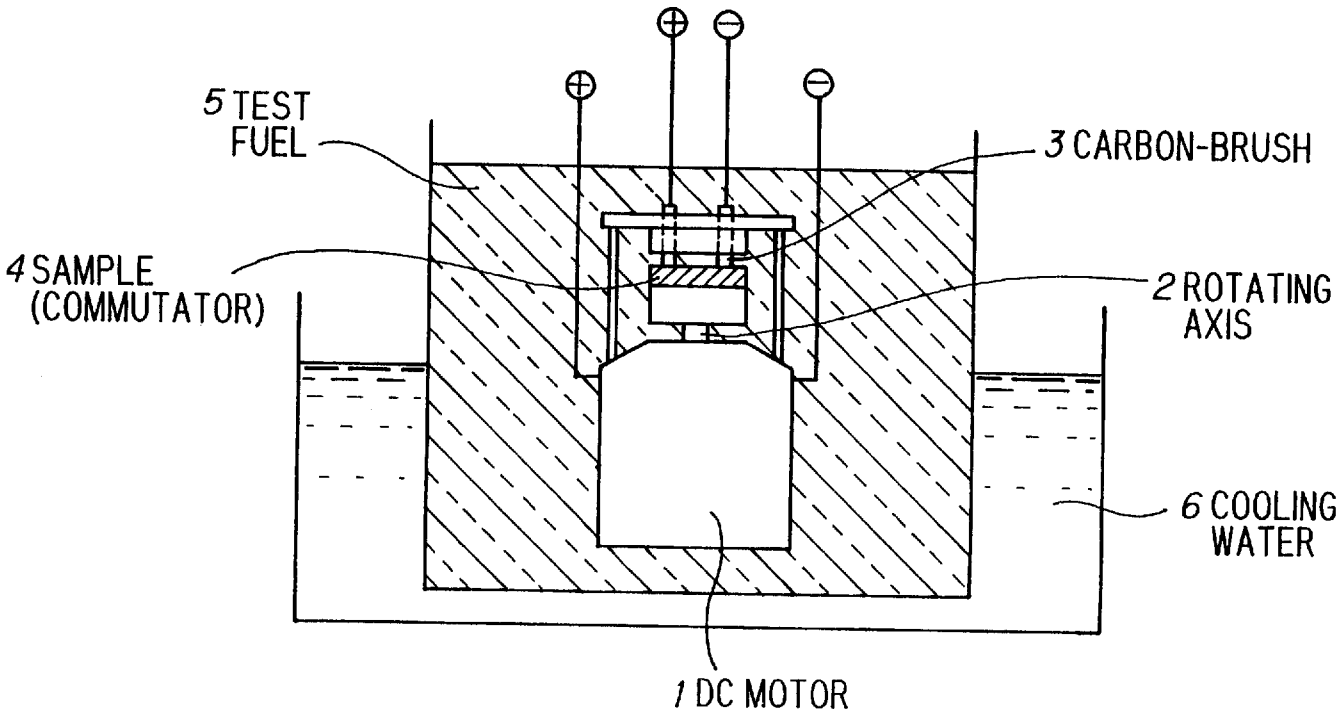
FIG. 1 is a cross-sectional view showing a test device for testing abrasive characteristics of samples in the invention.

A copper alloy according to the invention contains a predetermined weight percent of tin (Sn) and/or a predetermined weight percent nickel (Ni), i.e., as it belongs to the Cu—Sn alloy group and/or the Cu—Ni alloy group, its corrosion by alcohol can be avoided. Therefore, a commutator made of such a copper alloy is not likely to be corroded by an alcohol-containing fuel supply pump. It is known that a metal material in which precipitates are uniformly dispersed has better abrasive resistance characteristics. According to the copper alloy of the invention, as zirconium (Zr) is dispersed in the copper alloy and finely precipitated by a predetermined ageing treatment during its process, improved abrasive resistance characteristics are obtained.

According to the invention, the copper alloy consists essentially of 0.5 to 8 weight percent tin or nickel alone or in combination, 0.02 to 0.15 weight percent zirconium, and the remainder weight percent copper. If the total weight percent of tin or nickel alone or in combination is less than 0.5 percent, corrosion resistance characteristics are less improved. If it is more than 8 percent, manufacture of the copper alloy becomes difficult. Moreover, in this case, its material cost increases because of the higher cost of nickel.

In the invention, if the weight percent of zirconium is less than 0.02 percent, its abrasive resistance characteristics are less improved. On the other hand, if it is more than 0.15 percent, not only the improvement of such characteristics reaches a maximum, but also manufacture of the copper alloy becomes difficult.

Now, a preferred embodiment will be explained below. In order to make a copper alloy of the invention, electrolytic copper is melted in an argon (Ar) atmosphere in a high frequency electric furnace. Then tin or nickel alone or in combination, and zirconium, are added into the melted copper in the form of copper-based alloy(s). After pouring the melted copper alloy into a casting mold, ingots each having a diameter of 45 mm and a length of 150 mm, consisting of various compositions shown in TABLE 1 (see below) are obtained. Then, these ingots are heated at 800° C. and extruded into sheets having a thickness of 10 mm and a width of 30 mm. After being cooled by water, these sheets are cold-rolled, with annealing at 600° C. for 30 minutes at every 50% rolling reduction, so that they have a thickness of 2.5 mm. After that, the sheets are given a heat treatment at 600° C. for 1 hour (ageing treatment), then naturally cooled down to room temperature. Samples each having a disk shape of 40 mm diameter are cut out from each sheet.

FIG. 1 shows a test device for testing the abrasive characteristics of each sample in the invention, wherein each sample 4 is mounted on a top of a rotating axis 2 of a DC motor 1, a pair of carbon-brushes 3 are placed on the sample 4 so that a tip of each carbon-brush 3 is pressed down on the sample 4. All these parts are immersed in a test fuel 5, which is surrounded by cooling water 6 to form a test device. The test device is operated so that it rotates each sample 4 at 4000 rpm, and a direct current of 10 amperes flows in the sample 4 through the carbon-brushes 3. A test fuel which consists of 1 percent water, 84 percent alcohol and 15 percent gasoline is used. The test device is continuously operated in the test fuel 4 for 300 hours in each sample. After the operation, each sample is dismounted from the top of the rotating axis to measure the weight and area of its abrasive portion in order to calculate its abrasion value. The result is also shown in TABLE 1.

TABLE 1

| GROUP | SAMPLE No. | COMPOSITION OF ALLOY (weight percent) Sn | Ni | Zr | Ag | Cu | ABRASION VALUE ($g/cm^2$) |
|---|---|---|---|---|---|---|---|
| INVENTION | 1 | 4.0 | — | 0.05 | — | remainder | 0.2 |
| | 2 | — | 4.0 | 0.05 | — | remainder | 0.15 |
| | 3 | 2.0 | 2.0 | 0.05 | — | remainder | 0.25 |
| COMPARISON | 4 | 0.1 | — | — | — | remainder | 0.7 |
| | 5 | 4.0 | — | — | — | remainder | 0.8 |
| | 6 | — | 0.1 | — | — | remainder | 0.7 |
| PRIOR ART | 7 | — | — | — | 0.7 | remainder | 1.2 |

This result shows that the samples made of the copper alloy according to the invention have less than about one fifth (⅕) abrasion value of that made of prior art alloy (silver-containing copper alloy). This means that the samples in the invention, i.e., commutators made of the copper alloy according to the invention, have improved durability in an alcohol-containing fuel.

Although the invention has been described with respect to the specific embodiment for complete and clear disclosure, the appended claims are not to be thus limited but are to be construed as embodying all modifications and alternative constructions that may occur to one skilled in the art which fairly fall within the basic teaching set forth herein.

What is claimed is:

1. A method of improving the corrosion and abrasive resistance characteristics of a commutator of a motor which is used as part of a pump for supplying an alcohol-containing medium said method comprising:

providing said commutator as comprising a copper alloy usable in an alcohol-containing medium, said copper alloy consisting of:

0.5 to 8 weight percent in total of at least one of tin and nickel, 0.02 to 0.15 weight percent of zirconium, and the remainder copper;

wherein said zirconium is dispersed in said copper alloy as precipitates.

2. A method of improving the durability of a pump for supplying an alcohol-containing medium, said pump driven by a motor, said method comprising:

providing said motor with a commutator comprising a copper alloy, said copper alloy consisting of:

0.5 to 8 weight percent in total of at least one of tin and nickel, 0.02 to 0.15 weight percent of zirconium, and the remainder copper;

wherein said zirconium is dispersed in said copper alloy as precipitates.

* * * * *